US010076699B1

(12) United States Patent
Kim

(10) Patent No.: US 10,076,699 B1
(45) Date of Patent: Sep. 18, 2018

(54) SCOREBOARD APPARATUS FOR VARIOUS SPORTS GAMES

(71) Applicant: Sung Jai Kim, Gwangmyeong-si (KR)

(72) Inventor: Sung Jai Kim, Gwangmyeong-si (KR)

(73) Assignee: Sung Jai Kim, Gwangmyeong-si (KR)

( * ) Notice: Subject to any disclaimer, the term of this patent is extended or adjusted under 35 U.S.C. 154(b) by 0 days.

(21) Appl. No.: 15/691,009

(22) Filed: Aug. 30, 2017

(30) Foreign Application Priority Data

Mar. 16, 2017 (KR) ..... 10-2017-0032942

(51) Int. Cl.
*A63B 71/06* (2006.01)

(52) U.S. Cl.
CPC ..... *A63B 71/0669* (2013.01); *A63B 71/06* (2013.01); *A63B 71/0619* (2013.01); *A63B 71/0686* (2013.01); *A63B 2225/50* (2013.01)

(58) Field of Classification Search
CPC .. A63B 71/06; A63B 71/0619; A63B 71/0669
See application file for complete search history.

(56) References Cited

U.S. PATENT DOCUMENTS 3,981,002 A * 9/1976 Gardner ..... G04G 9/107 340/323 R
2004/0166966 A1* 8/2004 Nielsen ..... A63B 71/06 473/451
2008/0089666 A1* 4/2008 Aman ..... G06K 9/00 386/228
2012/0256373 A1* 10/2012 Tam ..... A63D 15/20 273/148 R
2014/0379868 A1* 12/2014 Nault ..... G06F 17/30165 709/219
2016/0213995 A1* 7/2016 Huebsch ..... A63B 71/06
2016/0277812 A1* 9/2016 Bokowski ..... H04N 21/8133
2018/0028895 A1* 2/2018 Stanfield ..... A63B 71/06

FOREIGN PATENT DOCUMENTS

JP 59-22172 U 2/1984
JP 3-53274 U 5/1991
JP 2010-5289 A 1/2010
JP 2015-195017 A 11/2015
JP 2016-75254 A 5/2016
(Continued)

OTHER PUBLICATIONS

Office Action issued by the Japan Patent Office for corresponding Japanese Patent Application No. 2017-163175, dated Jul. 3, 2018.
(Continued)

*Primary Examiner* — Andrew Bee
(74) *Attorney, Agent, or Firm* — Myers Wolin, LLC

(57) ABSTRACT

A scoreboard apparatus for various sports games, comprising: a display module, an operation panel module, control module and a wireless communication module, wherein the control module displays the proceeding information about the corresponding sports game on the display module according to the preset sports game corresponding to the input signal of the selected operation switch unit, when the control module continuously receives the input signal from any one operation switch unit selected from the plurality of operation switch units provided in the operation panel.

10 Claims, 15 Drawing Sheets

(56) References Cited

FOREIGN PATENT DOCUMENTS

| | | | |
|---|---|---|---|
| KR | 10-2011-0105603 | A | 9/2011 |
| KR | 10-1229640 | B1 | 1/2013 |
| KR | 20-0470344 | Y1 | 12/2013 |
| KR | 10-2015-0109096 | A | 10/2015 |

OTHER PUBLICATIONS

Office Action issued by the Korean Intellectual Property Office for corresponding Korean Patent Application No. 10-2017-0032942, dated May 12, 2017.

* cited by examiner

SCOREBOARD APPARATUS FOR VARIOUS SPORTS GAMES

This application claims priority from Korean Patent Application No. 10-2017-0032942 filed on Mar. 16, 2017 in the Korean Intellectual Property Office, the disclosure of which is incorporated herein by reference in its entirety.

BACKGROUND

1. Field of the Invention

The present invention relates to a scoreboard apparatus for various sports games, and more particularly, to a scoreboard apparatus for various sports games, which can easily check the proceeding information about various sports games.

2. Description of the Related Art

Generally, various sports games (for example, soccer, basketball, volleyball, baseball, badminton, and tennis) proceed in a manner that the winner and loser of both teams are determined by scores. In these sports games, a scoreboard is used to display the scores acquired by players of both teams.

When a sports game is held in a stadium or the like as an official game, the scores of players of both teams are displayed on a large electronic scoreboard fixed on the wall of the stadium by a game proceeding agent, a scorekeeper, a referee, or the like.

Recently, life sports facilities for the purpose of promoting public health have been installed throughout the country. However, in the friendly games or practice games of clubs and social groups conducted in such life sports facilities, it is difficult to use a large electronic scoreboard, so that the scores of both teams are displayed using number cards or a blackboard.

In particular, when a small number of persons gather and conduct a sports game, it is difficult to separately operate a game proceeding agent, a scorekeeper, a referee, or the like, so that it is also difficult to use number cards or a blackboard.

Therefore, the scores of both team depends on the memories of players of both teams. In this case, players of both teams forget the scores, and wrongly memorized scores lead to a sports game, thereby resulting in conflicts between the two teams.

Meanwhile, when the number of courts for a sports game is limited and a lot of people want to play a game, waiting players may exist. In this case, when the scores of both teams depend on the memories of players of both teams, current scores, current proceeding time, and the like cannot be known to the outside, so that it is substantially difficult for waiting players to predict when the previous game will end. (Patent Document 1) Korean Patent No. 10-1229640

SUMMARY

The present invention has been made to solve the above-mentioned problem, an aspect of the present invention is to provide a scoreboard apparatus for various sports games, which is easy to carry anywhere, can easily check the proceeding information about various sports games, and can be used universally in various sports games having different scoring systems and time-measuring sports games.

According to an aspect of the present invention provides a scoreboard apparatus for various sports games, comprising: a display module displaying proceeding information for each sports game; an operation panel module including a plurality of operation switch units and outputting an input signal for operating the display module through the operation of each of the operation switch units; a control module receiving the input signal of each of the operation switch units provided in the operation panel module and controlling to display the proceeding information about the corresponding sport game on the display module according to the sports game selected by the input signal of each of the operation switch units; and a wireless communication module receiving a scoreboard control signal transmitted from an external mobile communication terminal using a wireless communication method under the control of the control module, wherein the control module displays the proceeding information about the corresponding sports game on the display module according to the preset sports game corresponding to the input signal of the selected operation switch unit, when the control module 300 continuously receives the input signal from any one operation switch unit selected from the plurality of operation switch units provided in the operation panel module for preset reference time.

However, aspects of the present invention are not restricted to the one set forth herein. The above and other aspects of the present invention will become more apparent to one of ordinary skill in the art to which the present invention pertains by referencing the detailed description of the present invention given below.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION OF THE EMBODIMENTS

Figure 1:
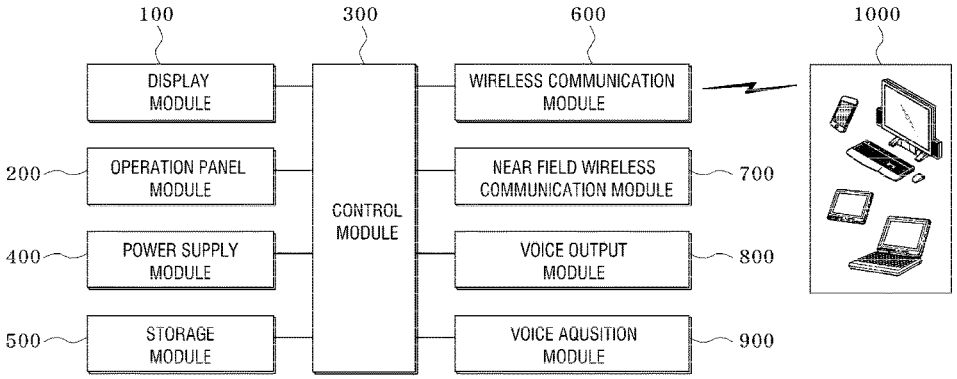
FIG. 1 is an overall block diagram for explaining a scoreboard apparatus for various sports games according to an embodiment of the present invention.

The above and other objects, features, and advantages of the present invention will be described in detail later with reference to the accompanying drawings. Accordingly, those skilled in the art can easily implement the technical idea of the present invention. In the description of the present invention, when it is determined that a detailed description of technologies related in the art unnecessarily obscure the gist of the present invention, a detailed description of the present invention will be omitted.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. The terms used herein are for the purpose of describing particular embodiments only and are not intended to be limiting of example embodiments of the invention. As used herein, the singular forms are intended to include the plural forms as well, unless the context clearly indicates otherwise.

Although general terms widely used and considering the functions in the present invention are selected as the terms used herein, these terms may vary depending on the intention of those skilled in the art, judicial precedents, the emergence of new technologies, or the like. Also, in certain cases, there may be terms selected arbitrarily by the applicant, in which case the meaning thereof will be described in detail in the description of the corresponding invention. Therefore, the terms used in the present invention should be defined based on the meaning of the terms, not the name of a simple term, and the entire contents of the present invention.

The terms "comprising," "having," "including," and "containing" are to be construed as open-ended terms (i.e., meaning "including, but not limited to,") unless otherwise noted. The terms "portion", "module", or the like used herein means a unit for processing at least one function or action, which may be implemented in hardware or software, or in a combination of hardware and software.

Hereinafter, preferred embodiments of the present invention will be described in detail with reference to the attached drawings. However, the following embodiments of the present invention may be modified into various other forms, and the scope of the present invention is not limited to these embodiments. The embodiments of the present invention are provided to enable those skilled in the art to more fully understand the present invention.

Each block of the accompanying block diagrams and combinations of steps of the flowchart may be performed by computer program instructions (execution engine). These computer program instructions may be embedded in a processor of a general purpose computer, special purpose computer, or other programmable data processing apparatus, so that the instructions, which may be executed by a processor of a computer or other programmable data processing apparatus, create means for performing the functions described in each step. Since these computer program instructions may also be stored in computer-usable or computer-readable memory capable of directing a computer or other programmable data processing apparatuses in order to implement a function in a particular manner, the instructions stored in the computer-usable or computer-readable memory are also capable of producing manufacturing items that contain instruction means for performing the functions described in each block or flowchart of the block diagrams.

Further, since the computer program instructions may be mounted on a computer or other programmable data processing equipment, a series of operational steps on a computer or other programmable data processing equipment may be performed to create a computer-executable process, and thus it is also possible for the instructions to perform a computer or other programmable data processing equipment to provide steps for executing the functions described in each block and flowchart of the block diagrams.

Each block may represent a part of a module, segment or code including one or more executable instructions for specified logical function(s). Further, it should be noted that, in some alternative execution examples, the functions mentioned in the blocks can occur out of the order. For example, two successively shown blocks can be substantially simultaneously executed, or can sometimes be executed in the reverse order depending on the corresponding function.

Figure 2:
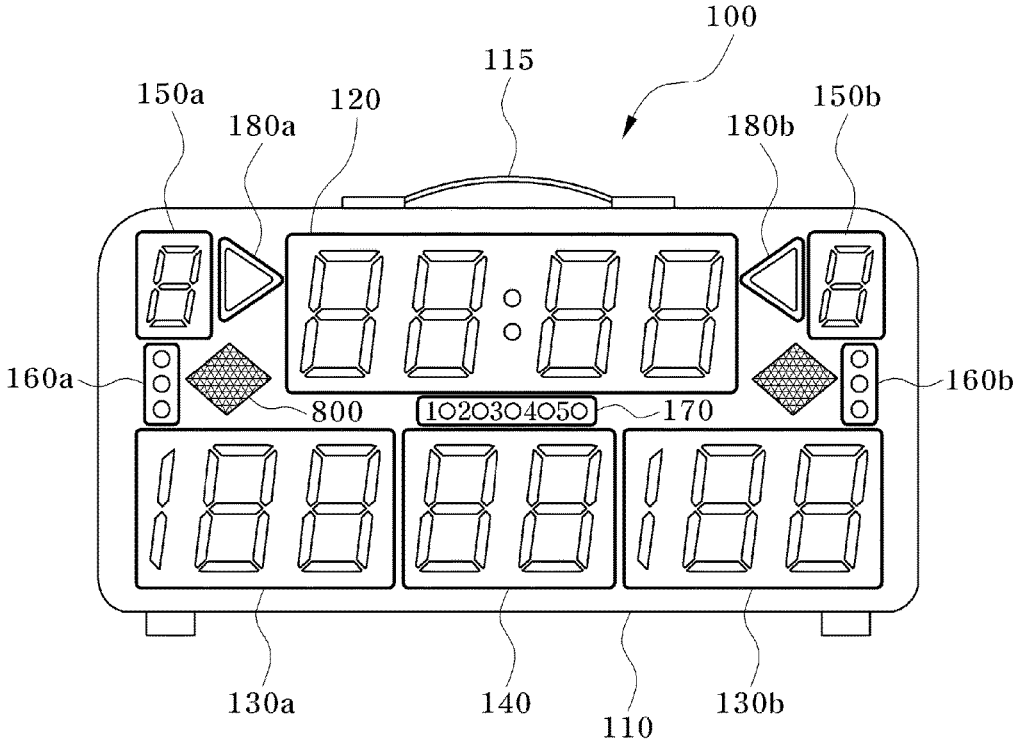
FIG. 2 is a plan view for specifically explaining the front side of a display module applied to an embodiment of the present invention.
Figure 3:
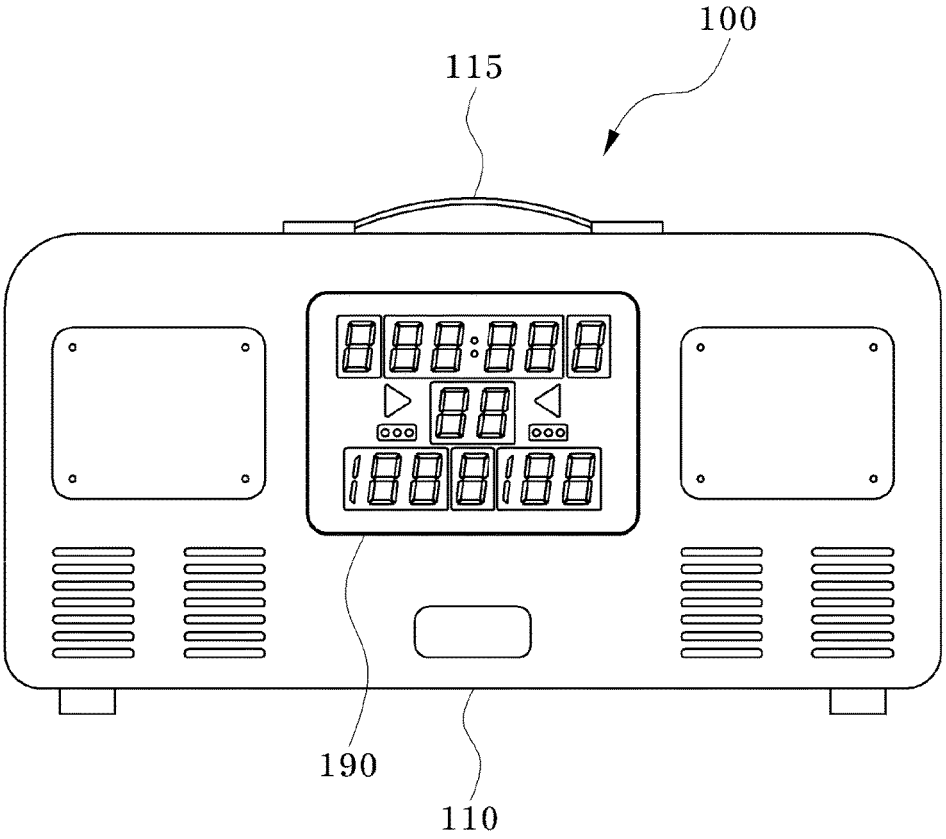
FIG. 3 is a plan view for specifically explaining the rear side of a display module applied to an embodiment of the present invention.
Figure 4:
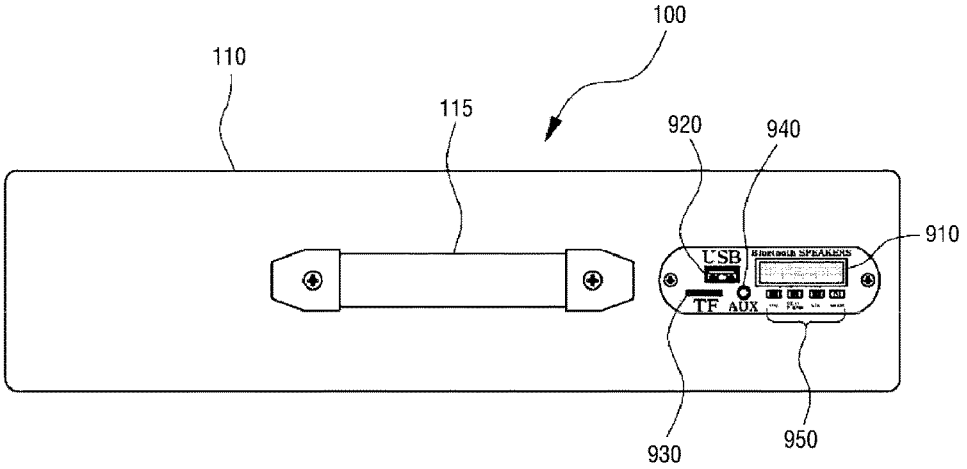
FIG. 4 is a plan view for specifically explaining the upper side of a display module applied to an embodiment of the present invention.
Figure 5:
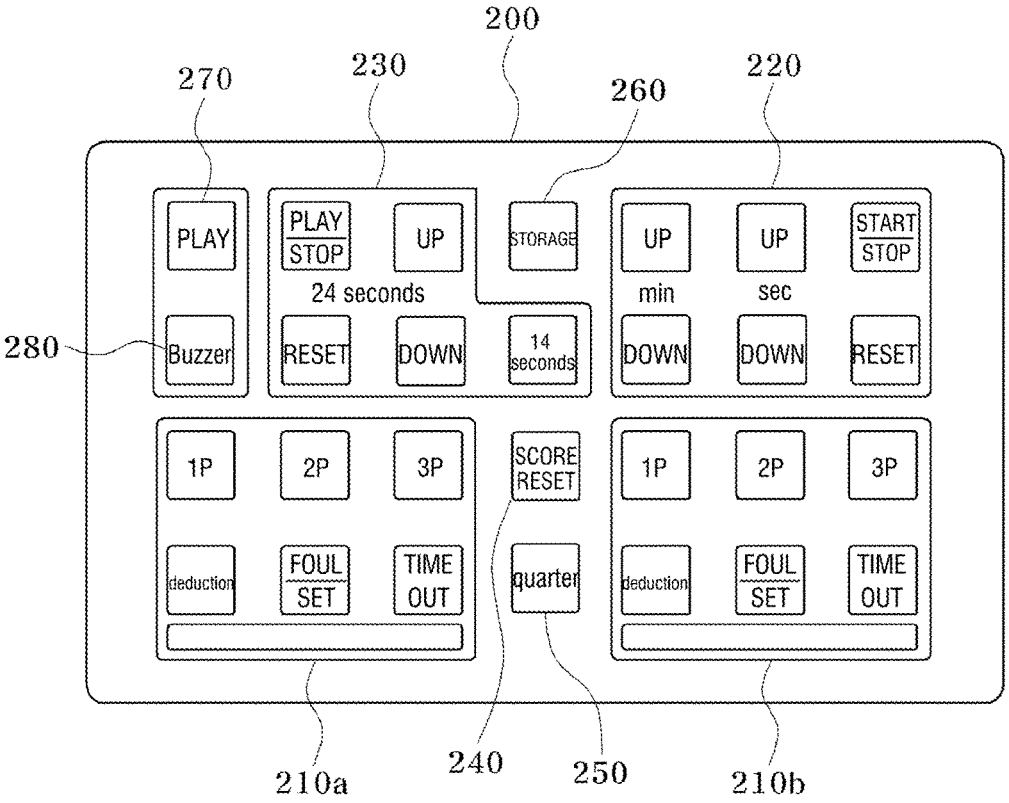
FIG. 5 is a plan view for specifically explaining an operation panel module applied to an embodiment of the present invention.

FIG. 1 is an overall block diagram for explaining a scoreboard apparatus for various sports games according to an embodiment of the present invention; FIG. 2 is a plan view for specifically explaining the front side of a display module applied to an embodiment of the present invention; FIG. 3 is a plan view for specifically explaining the rear side of a display module applied to an embodiment of the present invention; FIG. 4 is a plan view for specifically explaining the upper side of a display module applied to an embodiment of the present invention; FIG. 5 is a plan view for specifically explaining an operation panel module applied to an embodiment of the present invention; and FIGS. 6 to 13 are usage state views showing an example of displaying game proceeding information on a display module for each sports game using the scoreboard apparatus for various sport games according to an embodiment of the present invention.

Referring to FIGS. 1 to 13, the scoreboard apparatus for various sports games according to an embodiment of the present invention largely includes a display module 100, an operation panel module 200, a control module 300, and a power supply module 400.

The scoreboard apparatus for various sports games according to an embodiment of the present invention may further include a storage module 500, a wireless communication module 600, a near field wireless communication module 700, voice output module 800, and voice acquisition module 900. Meanwhile, since the components shown in FIG. 1 are not essential, the scoreboard apparatus for various sports games according to an embodiment of the present invention may have more or fewer components.

Hereinafter, the components of the scoreboard apparatus for various sports games according to an embodiment of the present invention will be described in detail as follows.

The display module 100 functions to display game proceeding information (for example, game proceeding time, timeout time, attack limit time, game scores, the number of sets in game, the number of quarters in game, the number of timeouts, game proceeding stage, the number of runs for each game proceeding stage, the number of fouls in game, and attack direction) for each sports game (for example, indoor soccer, shuttle run, volleyball, wrestling, basketball, badminton, table tennis, judo, or futsal) under the control of the control module 300.

The display module 100, as shown in FIG. 2, includes a main body 110, a first display unit 120, second display units 130*a* and 130*b*, a third display unit 140, fourth display units 150*a* and 150*b*, fifth display units 160*a* and 160*b*, a sixth display unit 170, seventh display units 180*a* and 180*b*, and an eighth display unit 190.

Here, the main body 110 is entirely formed in the shape of a rectangular parallelepiped box, and is provided such that a user can easily carry it to a specific place.

Preferably, a knob 115 is provided on one side (preferably, upper side) of the main body 110 so as to be held by a user's hand.

The first display unit 120 is provided on one side (preferably, front side) of the main body 110, and functions to display game proceeding time, timeout time, and the like according to the sport game selected by the input signals of a plurality of operation switch units 210 to 280 provided in the operation panel module 200.

The second display units 130*a* and 130*b* are provided on one side (preferably, front side) of the main body 110, and function to display game scores of both teams, game proceeding stage, and the like according to the sport game selected by the input signals of the plurality of operation switch units 210 to 280 provided in the operation panel module 200.

Preferably, these second display units 130*a* and 130*b* may be disposed to be spaced apart from each other by a predetermined distance under both sides of the lower end f the first display unit 120.

The third display unit 140 is provided on one side (preferably, front side) of the main body 110, and functions to display any one of the number of runs for each game proceeding stage, the number of sets in game, and attack limit time according to the sport game selected by the input signals of a plurality of operation switch units 210 to 280 provided in the operation panel module 200.

Preferably, this third display unit 140 is disposed between the second display unit 130*a* or 130*b* under the lower end of the first display unit 120.

The fourth display units 150*a* and 150*b* are provided on one side (preferably, front side) of the main body 110, and function to display the set scores of both teams in game, the number of fouls of both teams in game, and the like according to the sport game selected by the input signals of the plurality of operation switch units 210 to 280 provided in the operation panel module 200.

Preferably, these fourth display units 150*a* and 150*b* are disposed to be spaced apart from each other by a predetermined distance at left and right sides of the first display unit 120, and are formed to be smaller than the first display unit 120.

The fifth display units 160*a* and 160*b* are provided on one side (preferably, front side) of the main body 110, and function to display the number of timeouts of both teams according to the sport game selected by the input signals of the plurality of operation switch units 210 to 280 provided in the operation panel module 200.

Preferably, these fifth display units 160*a* and 160*b* are disposed between the second display unit 130*a* and the fourth display unit 150*a* and between the second display unit 130*b* and the fourth display unit 150*b*, respectively, under the lower ends of the fourth display units 150*a* and 150*b*. Further, preferably, each of these fifth display units 160*a* and 160*b* is configured such that a plurality of dots (for example, three dots) are arranged in a line (preferably, in a vertical direction) at regular intervals.

The sixth display unit 170 is provided on one side (preferably, front side) of the main body 110, and functions to display the number of quarters in game according to the sport game selected by the input signals of a plurality of operation switch units 210 to 280 provided in the operation panel module 200.

Preferably, this sixth display unit 170 is disposed between the first display unit 120 and the third display unit 140 under the lower end of the first display unit 120. Further, preferably, the sixth display unit 170 is configured such that a plurality of dots (for example, five dots) are arranged in a line (preferably, in a horizontal direction) to be spaced apart from each other at regular intervals together with numbers (for example, 1, 2, 3, 4, 5, and the like).

The seventh display units 180*a* and 180*b* are provided on one side (preferably, front side) of the main body 110, and function to display the attack directions of both teams according to the sport game selected by the input signals of the plurality of operation switch units 210 to 280 provided in the operation panel module 200.

Preferably, these seventh display units 180*a* and 180*b* are disposed between the first display unit 120 and the fourth display unit 150*a* and between the first display unit 120 and the fourth display unit 150*b* at the left and right sides of the first display unit 120, respectively, to be spaced apart from each other by a predetermined distance. Further, preferably, these seventh display units 180*a* and 180*b* are formed in a triangular shape to be symmetrical to each other with respect to the first display unit 120.

The eighth display unit 190 is provided to allow a game proceeding agent, a scorekeeper, a referee, or the like to easily check the game proceeding information. As shown in FIG. 3, the eighth display unit 190 is provided on the other side (preferably, rear side) of the main body 110, and functions to display the game proceeding information for each of the sport games displayed on the first to seventh display units 120 to 180*b* in the same manner under the control of the control module 300.

Preferably, the eighth display unit 190 may be provided to be smaller than the first to seventh display units 120 to 180*b*.

Meanwhile, preferably, the first to eighth display units 120 to 190 provided in the display module 100 may include at least one flexible numeric display (FND) for displaying numbers by second and minute units on a printed circuit board (PCB). However, the present invention is not limited thereto, and any display device may be used as long as it can display numbers, figures, and the like by second and minute units by using at least one 7-segment or at least one light emitting diode (LED).

For example, the first to eighth display units 120 to 190 include at least one of a liquid crystal display (LCD), a light emitting diode (LED), a thin film transistor liquid crystal display (TFT LCD), an organic light emitting diode (OLED), a flexible display, a plasma display panel (PDP), a surface alternate lighting (ALiS), digital light source processing (DLP), a silicon liquid crystal (LCoS), a surface conduction electron emitting device display (SED), a field emission display (FED), a laser TV (quantum dot laser, liquid crystal laser), a photovoltaic liquid crystal display (FLD), interferometric modulator display (iMoD), thick film dielectric electrical (TDEL), quantum dot display (QD-LED), a telescopic pixel display (TPD), an organic light emitting transistor (OLET), a laser fluorescent display (LPD), and a three-dimensional display (3D display). However, the present invention is not limited thereto, and the first to eighth display units 120 to 190 may include any device as long as it can display numbers, characters, figures, or the like.

The operation panel module 200 includes a plurality of operation switch units 210 to 280, and functions to output the input signals for operating the display module 100 by the operation of each of the operation switch units 210 to 280.

As shown in FIG. 5, the operation panel module 200 includes first operation switch units 210*a* and 210*b*, a second operation switch unit 220, a third operation switch unit 230, a fourth operation switch unit 240, a fifth operation switch section 250, a sixth switch unit 260, a seventh operation switch unit 270, and an eighth operation switch unit 280.

Here, the first operation switch units 210*a* and 210*b* are provided with a plurality of operation switches for counting the plus points (for example, 1P, 2P, and 3P buttons) and minus points (for example, deduction button) of scores of both teams in game, counting the number of fouls of both teams in game or the set scores of both teams in game (for example, foul/set button), and counting the number of timeouts of both teams in game (for example, timeout button), for each sport game.

The second operation switch unit 220 is provided with a plurality of operation switches for the start, stop and reset of game proceeding time or timeout time and the UP and DOWN adjustment of game proceeding time or timeout time (for example, min/sec), for each sports game.

The third operation switch unit 230 is provided with a plurality of operation switches for the set, start, stop and reset of reference attack limit time (for example, 14 second, 24 seconds) and the UP and DOWN adjustment of reference attack limit time, for each sports game.

The fourth operation switch unit 240 is provided with one operation switch (for example, score reset button) for resetting the scores of both teams for each sports game.

The fifth operation switch unit 240 is provided with one operation switch (for example, quarter button) for changing the number of quarters in game and the number of sets in game, for each sports game.

The sixth operation switch unit 260 is provided with one operation switch (for example, storage button) for storing the game proceeding time or timeout time set for each sports game.

The seventh operation switch unit 270 is provided with one operation switch (for example, PLAY button) for setting the attack directions of both teams for each sports game.

The eighth operation switch unit 280 is provided with one operation switch (for example, Buzzer button) for audibly outputting a preset sound source.

The control module 300 is a module for performing the overall control of the scoreboard apparatus for various sports games according to an embodiment of the present invention. Particularly, the control module 300 perform a function of controlling to receive input signals from the plurality of first to eighth operation switch units 210*a* to 280 provided in the operation panel module 200 and to display the game proceeding information of the corresponding sport game on the display module 100 according to the sport game selected by the input signal of each of the first to eighth operation switch units 210*a* to 280.

Further, when the control module 300 continuously receives input signals from any one operation switch unit selected from the plurality of first to eighth operation switch units 210*a* to 280 provided in the operation panel module 200 for the preset reference time (for example, for 5 seconds), the control module 300 may perform a function of controlling to display the proceeding information of the corresponding sports game on the display module according to the preset sports game corresponding to the input signal of the selected operation switch unit.

Further, when the control module 300 continuously receives input signals from any one operation switch unit selected from the plurality of first to eighth operation switch units 210*a* to 280 provided in the operation panel module 200 for the preset reference time (for example, for 5 seconds), the control module 300 may perform a function of controlling to display the unique numbers (for example, 1 to 11) of the preset sport game corresponding to the input signal of the selected operation switch unit through an addition display unit (not shown) provided in the selected operation switch unit.

Meanwhile, the additional display unit provided in the selected operation switch unit may be generally realized as at least one flexible numeric display (FND), 7-segment, light emitting diode (LED), or liquid crystal display (LCD) for displaying numbers on the lower portion of the selected operation switch unit.

Figure 6:
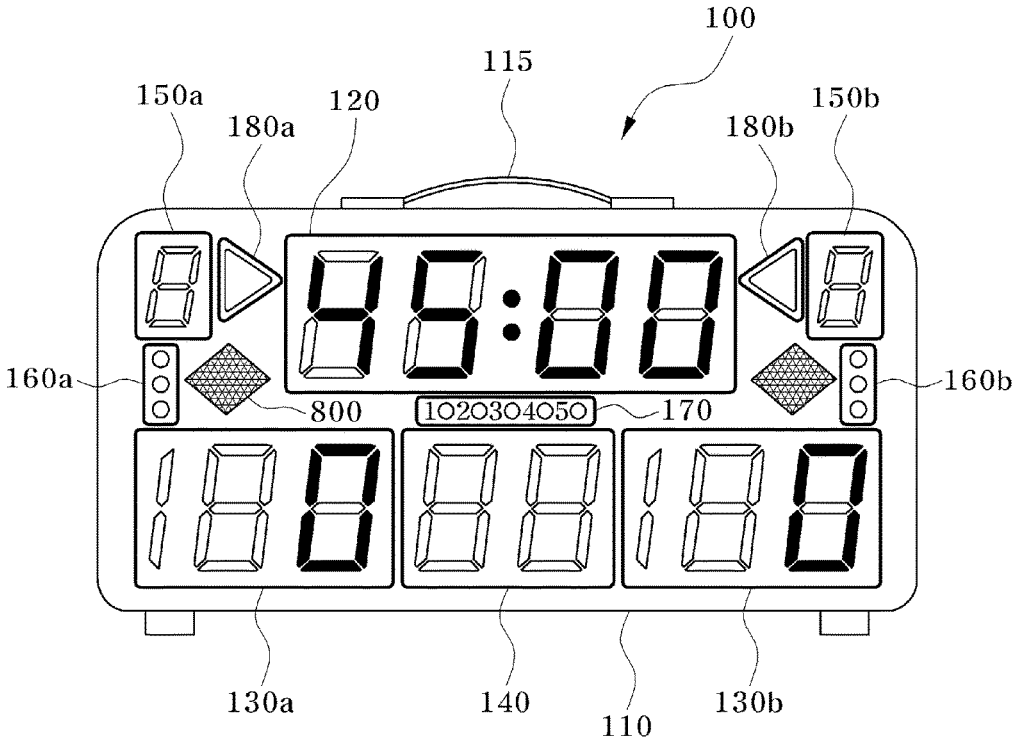
FIGS. 6 to 13 are usage state views showing an example of displaying game proceeding information on a display module for each sports game using the scoreboard apparatus for various sport games according to an embodiment of the present invention.

For example, as shown in FIG. 6, when the seventh operation switch unit 270 (for example, PLAY button) selected from the plurality of first to eighth switch units 210*a* to 280 provided in the operation panel module 200 is continuously pushed for the preset reference time (for example, for 5 seconds), the unique number (for example, 1) of the preset sport game (for example, indoor soccer) corresponding to the input signal of the selected seventh operation switch unit 270 is displayed through an addition display unit provided in the selected seventh operation switch unit 270, and the game proceeding information of the corresponding sports game (for example, indoor soccer) is displayed on the display module 100 according to the preset sports game (for example, indoor soccer).

That is, when the preset sport game corresponding to the input signal of the selected seventh operation switch unit 270 is indoor soccer, the control module 300 may perform a function of controlling to display the game proceeding time (for example, 45 minutes in the first half, 45 minutes in the second half, total 90 minutes) of the indoor soccer game set by the input signal of the second operation switch unit 220 provided in the operation panel module 200 on the first display unit 120 provided in the display module 100.

Further, the control module 300 may perform a function of controlling to store the game proceeding time of the indoor soccer game set by the input signal of the second operation switch unit 220 in an additional storage module 500 according to the input signal of the sixth operation switch unit 260 (for example, storage button) provided in the operation panel module 200.

Further, the control module 300 may perform a function of controlling to display the counting of the plus points (for example, 1P button) and/or minus points (for example, deduction button) of scores of both teams on the second display units 130*a* and 130*b* provided in the display module 100 according to the input signals of the first operation switch units 210*a* and 210*b* provided in the operation panel module 200.

Figure 7:
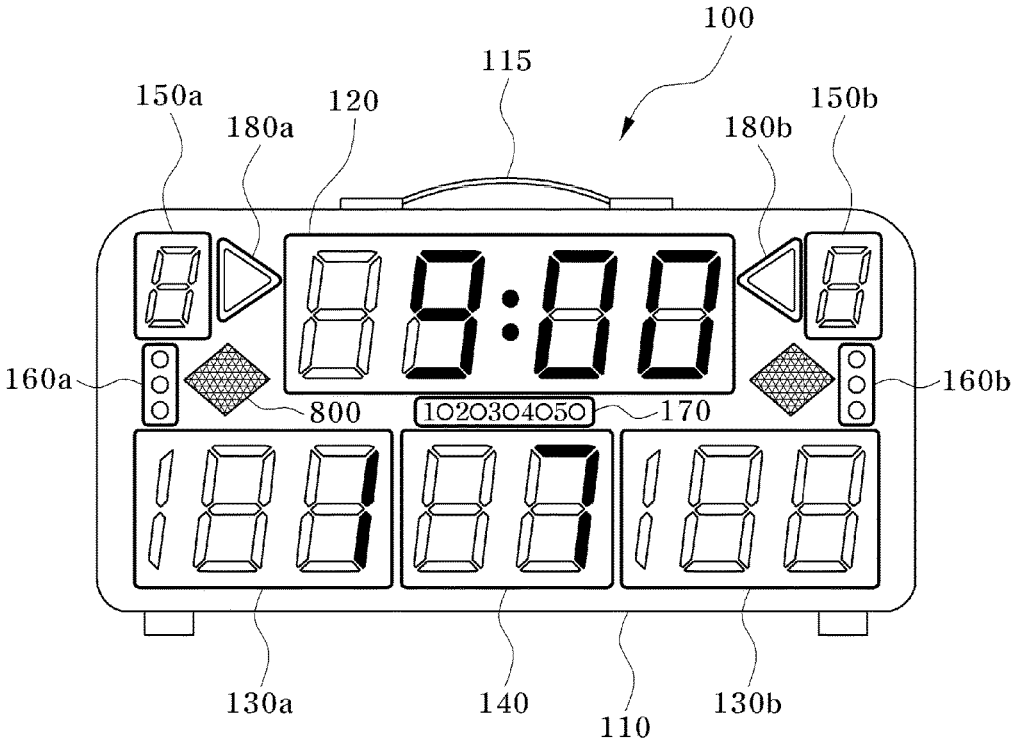

As another example, as shown in FIG. 7, when the third operation switch unit 230 (for example, 24 seconds, start/stop button) selected from the plurality of first to eighth switch units 210*a* to 280 provided in the operation panel module 200 is continuously pushed for the preset reference time (for example, for 5 seconds), the unique number (for example, 2) of the preset sport game (for example, shuttle run) corresponding to the input signal of the selected third operation switch unit 230 is displayed through an addition display unit provided in the selected third operation switch unit 230, and the game proceeding information of the corresponding sports game (for example, shuttle run) is displayed on the display module 100 according to the preset sports game (for example, shuttle run).

That is, when the preset sport game corresponding to the input signal of the selected third operation switch unit 230 is shuttle run, the control module 300 may perform a function of controlling to display the game proceeding time (for example, 9 to 3.89 seconds) for each game proceeding stage of the preset shuttle run on the first display unit 120 provided in the display module 100.

Further, the the control module 300 may perform a function of controlling to display the currently game proceeding stage of shuttle run on the second display units 130*a* and 130*b* provided in the display module 100, and may further perform a function of controlling to display reference shuttle run counter (for example, 7 to 16 times) for each game proceeding stage of the preset shuttle run on the third display unit 140 provided in the display module 100.

Figure 8:
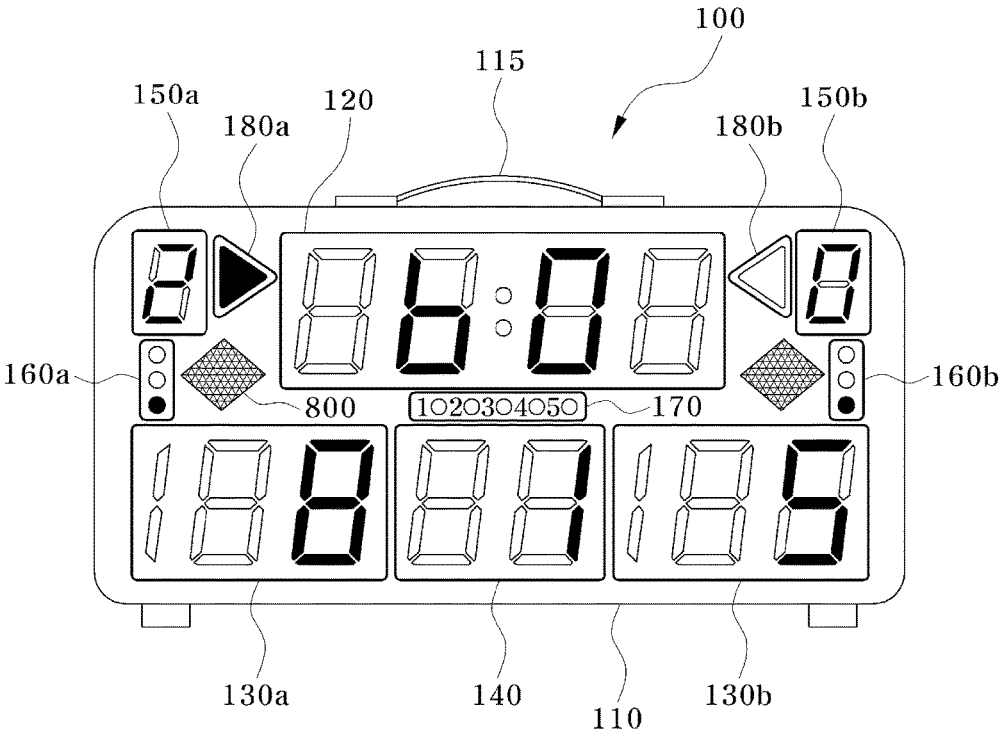

As still another example, as shown in FIG. 8, when the third operation switch unit 230 (for example, 24 seconds, UP button) selected from the plurality of first to eighth switch units 210*a* to 280 provided in the operation panel module 200 is continuously pushed for the preset reference time (for example, for 5 seconds), the unique number (for example, 3) of the preset sport game (for example, volleyball) corresponding to the input signal of the selected third operation switch unit 230 is displayed through an addition display unit provided in the selected third operation switch unit 230, and the game proceeding information of the corresponding sports game (for example, volleyball) is displayed on the display module 100 according to the preset sports game (for example, volleyball).

That is, when the preset sport game corresponding to the input signals of the selected third operation switch unit 230 is volleyball, the control module 300 may perform a function of controlling to display the number of timeouts of both teams (for example, available once per set) on the fifth display units 160*a* and 160*b* provided in the display module 100 according to the input signals of the first operation switch units 210*a* and 210*b* provided in the operation panel module 200.

Further, the control module 300 may perform a function of controlling to display the timeout time (for example, 60 seconds) of the volleyball game set by the input signal of the second operation switch unit 220 provided in the operation panel module 200 on the first display unit 120 provided in the display module 100.

Further, the control module 300 may perform a function of controlling to store the timeout time (for example, 60 seconds) of the volleyball game set by the input signal of the second operation switch unit 220 provided in the operation panel module 200 in an additional storage module 500 according to the input signal of the sixth operation switch unit 260 (for example, storage button) provided in the operation panel module 200.

Further, the control module 300 may perform a function of controlling to display the counting of the plus points (for example, 1P button) and/or minus points (for example, deduction button) of scores of both teams on the second display units 130*a* and 130*b* provided in the display module 100 according to the input signals of the first operation switch units 210*a* and 210*b* provided in the operation panel module 200.

Further, the control module 300 may perform a function of controlling to display the number of sets in game (for example, 1 to 5 sets) on the third display unit 130 provided in the display module 100 according to the input signal of the fifth operation switch unit 250 (for example, quarter button) provided in the operation panel module 200.

Further, the control module 300 may perform a function of controlling to display the game set scores of both teams (for example, 1 to 5 sets) on the fourth display units 150*a* and 150*b* provided in the display module 100 according to the input signals of the first operation switch units 210*a* and 210*b* (for example, foul/set button) provided in the operation panel module 200.

Further, the control module 300 may perform a function of controlling to display the attack directions of both teams on the seventh display units 180*a* and 180*b* provided in the display module 100 according to the input signal of the seventh operation switch unit 270 provided in the operation panel module 200.

Figure 9:
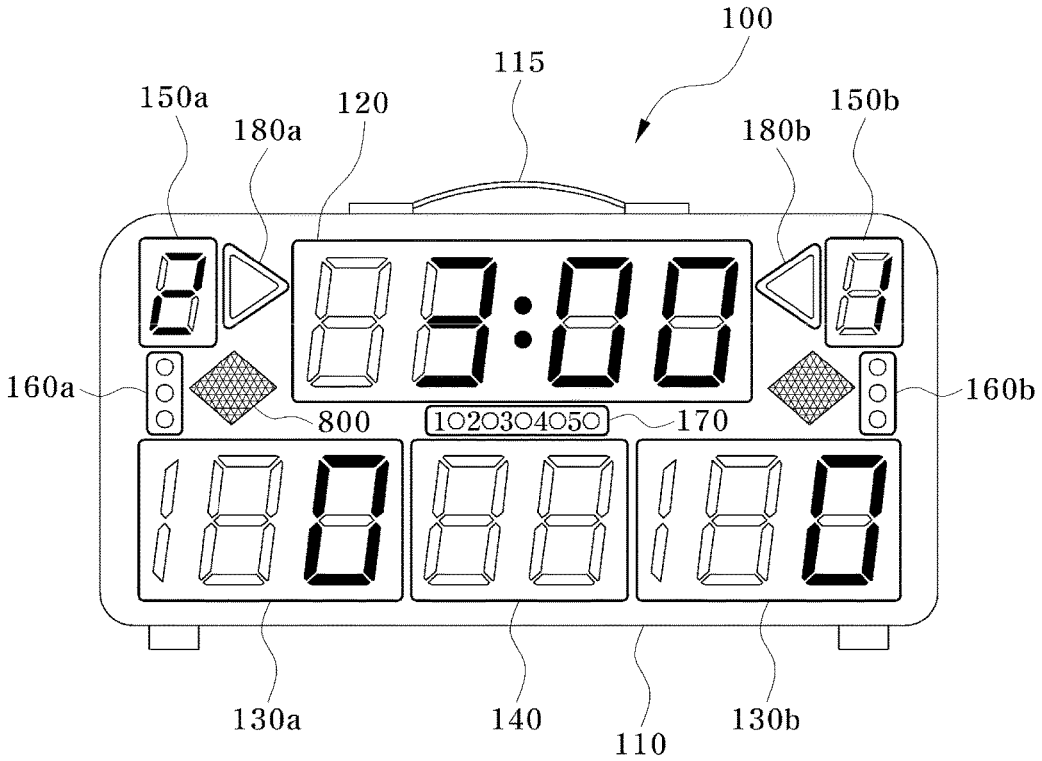

As still another example, as shown in FIG. 9, when the second operation switch unit 220 (for example, 24 seconds, UP button) selected from the plurality of first to eighth switch units 210*a* to 280 provided in the operation panel module 200 is continuously pushed for the preset reference time (for example, for 5 seconds), the unique number (for example, 5) of the preset sport game (for example, wrestling) corresponding to the input signal of the selected second operation switch unit 220 is displayed through an addition display unit provided in the selected second operation switch unit 220, and the game proceeding information of the corresponding sports game (for example, wrestling) is displayed on the display module 100 according to the preset sports game (for example, wrestling).

That is, when the preset sport game corresponding to the input signal of the selected second operation switch unit 220 is wrestling, the control module 300 may perform a function of controlling to display the game proceeding time (for example, three rounds three minutes) of wrestling game set by the input signal of the second operation switch unit 220 provided in the operation panel module 200 on the first display unit 120 provided in the display module 100.

Further, the control module 300 may perform a function of controlling to store the game proceeding time (for example, three rounds three minutes) of wrestling game set by the input signal of the second operation switch unit 220 provided in the operation panel module in an additional storage module 500 according to the input signal of the sixth operation switch unit 260 (for example, storage button) provided in the operation panel module 200.

Further, the control module 300 may perform a function of controlling to display the counting of the plus points (for example, 1P, 2P and 3P buttons) and/or minus points (for example, deduction button) of scores of both teams on the second display units 130*a* and 130*b* provided in the display module 100.

Further, the control module 300 may perform a function of controlling to display the number of fouls of both teams (for example, three fouls can be inputted) on the fourth display units 150*a* and 150*b* provided in the display module 100 according to the input signals of the first operation switch units 210*a* and 210*b* (for example, foul/set button) provided in the operation panel module 200.

Further, the control module 300 may perform a function of controlling to automatically display the preset break time (for example, 30 seconds) on the first display unit 120 provided in the display module 100 when each round (for example, three rounds) ends. Meanwhile, the forcible termination of the break time can be performed by using the game proceeding time START/STOP button provided in the second operation switch unit 220.

Figure 10:
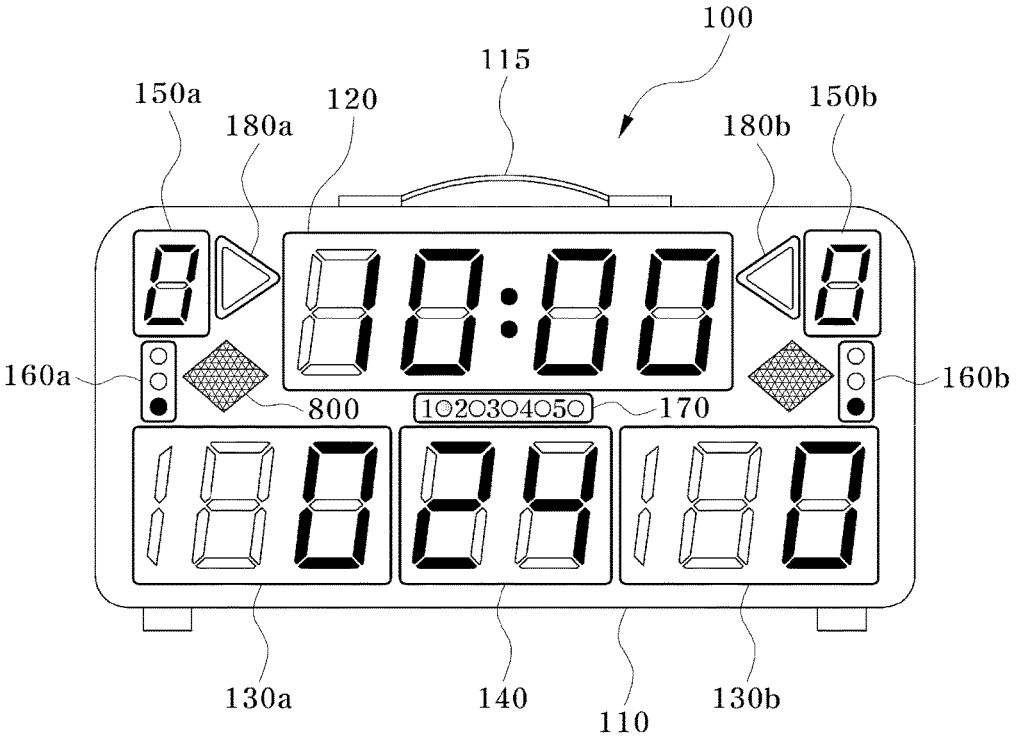

As still another example, as shown in FIG. 10, when the second operation switch unit 220 (for example, game proceeding time START/STOP button) selected from the plurality of first to eighth switch units 210*a* to 280 provided in the operation panel module 200 is continuously pushed for the preset reference time (for example, for 5 seconds), the unique number (for example, 6) of the preset sport game (for example, basketball) corresponding to the input signal of the selected second operation switch unit 220 is displayed through an addition display unit provided in the selected second operation switch unit 220, and the game proceeding information of the corresponding sports game (for example, basketball) is displayed on the display module 100 according to the preset sports game (for example, basketball).

That is, when the preset sport game corresponding to the input signals of the selected second operation switch unit 220 is basketball, the control module 300 may perform a function of controlling to display the game proceeding time (for example, 1 to 4 quarters, 10 minutes) of basketball game set by the input signal of the second operation switch unit 220 provided in the operation panel module 200 on the first display unit 120 provided in the display module 100.

Further, the control module 300 may perform a function of controlling to store the game proceeding time (for example, 1 to 4 quarters, 10 minutes) of basketball game set by the input signals of the second operation switch unit 220 provided in the operation panel module 200 in an additional storage module 500 according to the input signal of the sixth operation switch unit 260 (for example, storage button) provided in the operation panel module 200.

Further, the control module 300 may perform a function of controlling to display the counting of the plus points (for example, 1P, 2P and 3P buttons) and/or minus points (for example, deduction button) of scores of both teams on the second display units 130*a* and 130*b* provided in the display module 100 according to the input signals of the first operation switch units 210*a* and 210*b* provided in the operation panel module 200.

Further, the control module 300 may perform a function of controlling to display the reference attack limit time (for example, 24 seconds) of basketball game set by the input signal of the third operation switch unit 230 provided in the operation panel module on the third display unit 140 provided in the display module 100.

Further, the control module 300 may perform a function of controlling to display the number of fouls of both teams on the fourth display units 150*a* and 150*b* provided in the display module 100 according to the input signals of the first operation switch units 210*a* and 210*b* (for example, foul/set button) provided in the operation panel module 200.

Further, the control module 300 may perform a function of controlling to display the number of timeouts of both teams on the fifth display units 160*a* and 160*b* provided in the display module 100 according to the input signals of the first operation switch units 210*a* and 210*b* (for example, timeout button) provided in the operation panel module 200.

Further, the control module 300 may perform a function of controlling to display the number of quarters in the basket ball game (for example, 1 to 4 quarters) on the sixth display unit 170 provided in the display module 100 according to the input signal of the fifth operation switch unit 250 (for example, quarter button) provided in the operation panel module 200.

Figure 11:
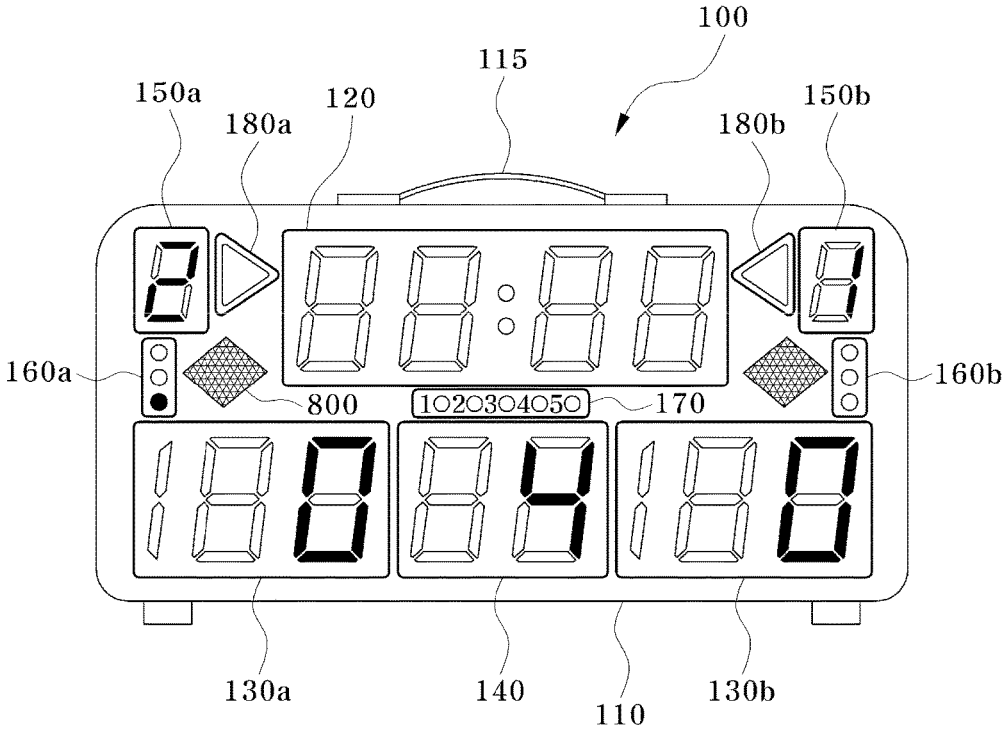

As still another example, as shown in FIG. 11, when the first operation switch units 210*a* and 210*b* (for example, deduction buttons) selected from the plurality of first to eighth switch units 210*a* to 280 provided in the operation panel module 200 are continuously pushed for the preset reference time (for example, for 5 seconds), the unique number (for example, 7) of the preset sport game (for example, badminton or table tennis) corresponding to the input signals of the selected first operation switch units 210*a* and 210*b* is displayed through an addition display unit provided in the first operation switch units 210*a* and 210*b*, and the game proceeding information of the corresponding sports game (for example, badminton or table tennis) is displayed on the display module 100 according to the preset sports game (for example, badminton or table tennis).

That is, when the preset sport game corresponding to the input signals of the selected first operation switch units 210*a* and 210*b* is badminton or table tennis, the control module 300 may perform a function of controlling to display the counting of the plus points (for example, 1P button) and/or minus points (for example, deduction button) of scores of both teams on the second display units 130*a* and 130*b* provided in the display module 100 according to the input signals of the first operation switch units 210*a* and 210*b* provided in the operation panel module 200.

Further, the control module 300 may perform a function of controlling to display the number of sets in the badminton game or table tennis game (for example, 1 to 9 sets) on the third display unit 140 provided in the display module 100 according to the input signal of the fifth operation switch unit 250 (for example, quarter button) provided in the operation panel module 200.

Further, the control module 300 may perform a function of controlling to display the set scores of both teams on the fourth display units 150*a* and 150*b* provided in the display module 100 according to the input signals of the first operation switch units 210*a* and 210*b* (for example, foul/set button) provided in the operation panel module 200.

Further, the control module 300 may perform a function of controlling to display the number of timeouts of both teams on the fifth display units 160*a* and 160*b* provided in the display module 100 according to the input signals of the first operation switch units 210*a* and 210*b* (for example, timeout button) provided in the operation panel module 200.

Figure 12:
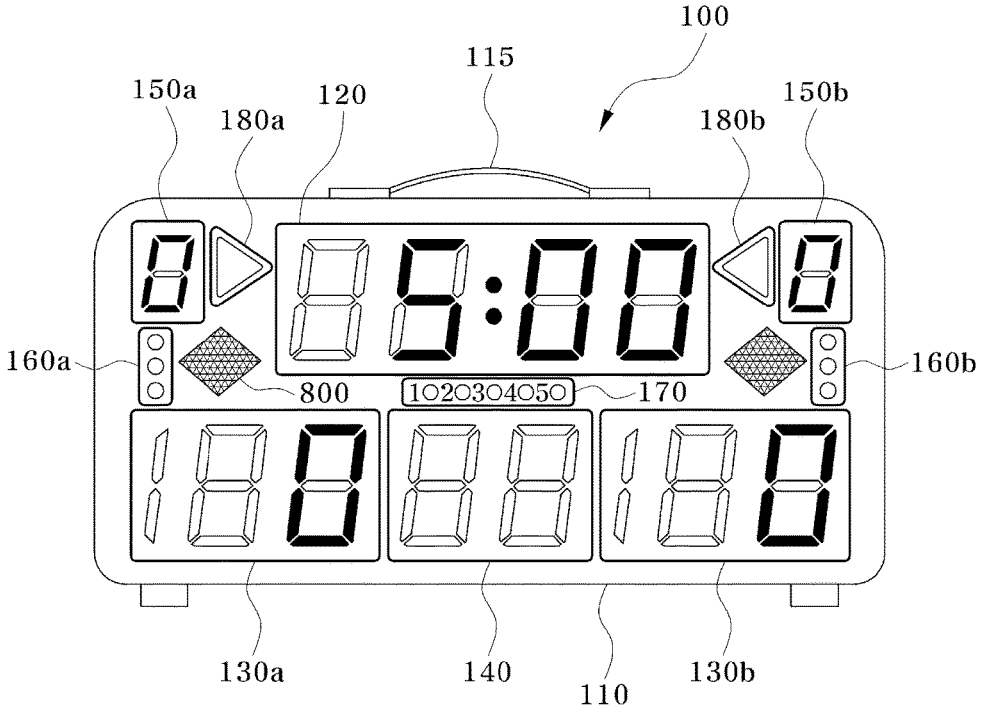

As still another example, as shown in FIG. 12, when the first operation switch units 210*a* and 210*b* (for example, foul/set buttons) selected from the plurality of first to eighth switch units 210*a* to 280 provided in the operation panel module 200 are continuously pushed for the preset reference time (for example, for 5 seconds), the unique number (for example, 8) of the preset sport game (for example, judo) corresponding to the input signals of the selected first operation switch units 210*a* and 210*b* is displayed through an addition display unit provided in the first operation switch units 210*a* and 210*b*, and the game proceeding information of the corresponding sports game (for example, judo) is displayed on the display module 100 according to the preset sports game (for example, judo).

That is, when the preset sport game corresponding to the input signals of the selected first operation switch units 210*a* and 210*b* is judo, the control module 300 may perform a function of controlling to display the proceeding time (for example, 5 minutes) of judo game set by the input signal of the second operation switch unit 220 provided in the operation panel module 200 on the first display unit 120 provided in the display module 100.

Further, the control module 300 may perform a function of controlling to store the game proceeding time (for example, 5 minutes) of judo game set by the input signals of the second operation switch unit 220 provided in the operation panel module 200 in an additional storage module 500 according to the input signal of the sixth operation switch unit 260 (for example, storage button) provided in the operation panel module 200.

Further, the control module 300 may perform a function of controlling to display the counting of the plus points (for example, 1P, 2P and 3P buttons) and/or minus points (for example, deduction button) of scores of both teams on the second display units 130*a* and 130*b* provided in the display module 100 according to the input signals of the first operation switch units 210*a* and 210*b* provided in the operation panel module 200.

Further, the control module 300 may perform a function of controlling to display the number of fouls of both teams on the fourth display units 150*a* and 150*b* provided in the display module 100 according to the input signals of the first operation switch units 210*a* and 210*b* (for example, foul/set button) provided in the operation panel module 200.

Figure 13:
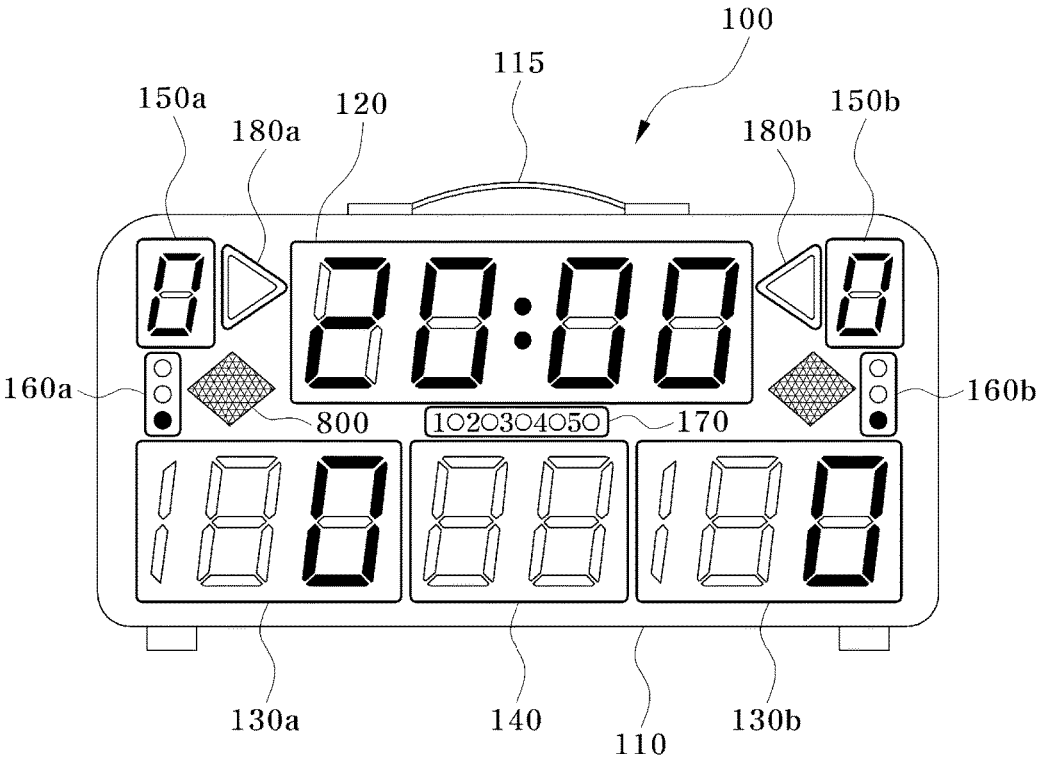

As still another example, as shown in FIG. 13, when the first operation switch units 210*a* and 210*b* (for example, operation buttons) selected from the plurality of first to eighth switch units 210*a* to 280 provided in the operation panel module 200 are continuously pushed for the preset reference time (for example, for 5 seconds), the unique number (for example, 9) of the preset sport game (for example, futsal) corresponding to the input signals of the selected first operation switch units 210*a* and 210*b* is displayed through an addition display unit provided in the first operation switch units 210*a* and 210*b*, and the game proceeding information of the corresponding sports game (for example, futsal) is displayed on the display module 100 according to the preset sports game (for example, futsal).

That is, when the preset sport game corresponding to the input signals of the selected first operation switch units 210*a* and 210*b* is futsal, the control module 300 may perform a function of controlling to display the game proceeding time (for example, 20 minutes in the first half, 20 minutes in the second half, total 40 minutes) of futsal game set by the input signal of the second operation switch unit 220 provided in the operation panel module 200 on the first display unit 120 provided in the display module 100.

Further, the control module 300 may perform a function of controlling to store the game proceeding time (for example, 20 minutes in the first half, 20 minutes in the second half, total 40 minutes) of futsal game set by the input signal of the second operation switch unit 220 provided in the operation panel module 200 in an additional storage module 500 according to the input signal of the sixth operation switch unit 260 (for example, storage button) provided in the operation panel module 200.

Further, the control module 300 may perform a function of controlling to display the counting of the plus points (for example, 1P button) and/or minus points (for example, deduction button) of scores of both teams on the second display units 130*a* and 130*b* provided in the display module 100 according to the input signals of the first operation switch units 210*a* and 210*b* provided in the operation panel module 200.

Further, the control module 300 may perform a function of controlling to display the number of fouls of both teams (for example, 1 to 9) on the fourth display units 150*a* and 150*b* provided in the display module 100 according to the input signals of the first operation switch units 210*a* and 210*b* (for example, foul/set button) provided in the operation panel module 200.

Further, the control module 300 may perform a function of controlling to display the number of timeouts of both teams on the fifth display units 160*a* and 160*b* provided in the display module 100 according to the input signals of the first operation switch units 210*a* and 210*b* (for example, timeout button) provided in the operation panel module 200, and may perform a function of controlling to display the preset timeout time (for example, 60 seconds) on the first display unit 120 provided in the display module 100.

Meanwhile, the control module 300 may perform a function of controlling to display the game proceeding information for each sports game (for example, indoor soccer, shuttle run, volleyball, wrestling, basketball, badminton, table tennis, judo, and futsal) on the display module 100 according to the control signals of the scoreboard, received from the wireless communication module 600.

Further, the control module 300 may perform a function of controlling to output the preset voice or sound source data or voice or sound source data received from an external mobile communication terminal 1000 through the voice output module 800, and may perform a function of controlling to output external voice information acquired from the voice acquisition module 900 through the voice output module 800.

In this case, preferably, the external mobile communication terminal 1000 may be a mobile terminal device including at least one of a smart phone, a smart pad, and a smart note, which communicate through a wireless internet or a portable internet. In addition, the external mobile communication terminal 1000 may include all wired and wireless home appliances/communication devices having user interfaces for connecting to the control module 300, such as a palm PC, a mobile play station, a digital multimedia broadcasting (DMB) phone having a communication function, a tablet PC, and an iPad.

In particular, when the mobile communication terminal 1000 is implemented as a smart phone, the smart phone, unlike a general phone, is a phone based on an open operating system that allows users to freely use and delete a variety of downloaded application programs. Preferably, it is understood that the smart phone is communication device including mobile phones having mobile office functions as well as generally used voice/video call functions and internet data communication functions or all internet phones and tablet PCs having internet connection functions without voice call functions.

Such a smart phone can be implemented as a smart phone equipped with various open operating systems. Examples of the open operating systems may include NOKIA's Symbian, RIMS's BlackBerry, Apple's iPhone, Microsoft's Windows Mobile, Google's Google Android, and Samsung's Bada.

As described above, since the smart phone uses an open operating system, a user can arbitrarily install and manage various application programs, unlike a mobile phone having a closed operating system.

That is, the smart phone basically includes a control unit, a memory unit, an image output unit, a key input unit, a sound output unit, a sound input unit, a camera unit, a wireless network communication module, a near field wireless communication module, and a battery for power supply.

The control unit is a generic term of functional configurations for controlling the operation of the smart phone. The control unit includes at least one processor and an execution memory, and is connected to each functional unit included in the smart phone through a bus (BUS).

The control unit controls the operation of the smart phone by loading at least one program code included in the smart phone into the execution memory through a processor, calculating the program code, and transmitting the result to at least one functional unit through a bus.

The memory unit, which is a general term of nonvolatile memory included in the smart phone, stores and maintains at least one program code executed through the control unit and at least one data set in which the program code is used. The memory unit basically stores a system program code and a system data set corresponding to an operating system of the smart phone, a communication program code and a communication data set for processing a wireless communication connection of the smart phone, at least one application program code and an application data set. The program code and data set for realizing the present invention are also stored in the memory unit.

The image output unit includes an image output device (for example, LCD or LED) and an output module for driving the image output device. The image output unit is connected to the control unit through a bus, and outputs an operation result corresponding to an image output among the various operation results of the control unit to the image output device.

The key input unit includes a key input device having at least one key button (or a touch screen device interlocked with the image output unit) and an input module for driving the key input device. The key input unit is connected to the control unit through a bus, and inputs a command for commanding various operations of the control unit, or inputs data necessary for the operation of the control unit.

The sound output unit includes a speaker for outputting a sound signal and a sound module for driving the speaker. The sound output unit is connected to the control unit through a bus, and outputs an operation result corresponding to a sound output among the various operation results of the control unit through the speaker. The sound module decodes sound data to be outputted through the speaker and converts the sound data into a sound signal.

The sound input unit includes a microphone for receiving a sound signal and a sound module for driving the microphone. The sound input unit transmits the sound data input through the microphone to the control unit. The sound module encodes a sound signal input through the microphone.

The camera unit includes an optical unit, a CCD (Charge Coupled Device), and a camera module for driving the CCD. The camera unit acquires bitmap data input to the CCD through the optical unit. The bitmap data may include both still image data and moving image data.

The wireless network communication module, which is a general term of communication configurations for connecting wireless communication, includes at least one of an antenna for transmitting and receiving a radio frequency signal of a specific frequency band, an RF module, a baseband module, and a signal processing module. The wireless network communication module is connected to the control unit through a bus, and transmits an operation result corresponding to wireless communication among the various operation results of the control unit through wireless communication or receives data through wireless communication and transmits the data to the control unit, and maintains the procedures of connection, registration, communication and handoff of the wireless communication.

Further, the wireless network communication module includes a mobile communication configuration that performs at least one of connection to a mobile communication network, location registration, call processing, call connection, data communication, and handoff according to the CDMA/WCDMA standard. Meanwhile, according to the intention of those skilled in the art, the wireless network communication module may further include a portable internet communication configuration for performing at least one of connection to a portable internet, location registration, data communication, and handoff according to the IEEE 802.16 standard. It is evident that the present invention is not limited by the wireless communication configuration provided by the wireless network communication module.

The near field wireless communication module is configured a near field wireless communication module for connecting communication sessions using a radio frequency signal as a communication medium within a predetermined distance. Preferably, the near field wireless communication module may include at least one of RFID communication, Bluetooth communication, Wi-Fi communication, and public wireless communication according to the ISO 180000 series standards.

The power supply module 400 is provided in the main body 110 of the display module 100, and functions to supply power necessary for the respective modules, that is, the display module 100, the operation panel module 200, the control module 300, the storage module 500, the wireless communication module 600, the near filed wireless communication module 700, the voice output module 800, and the voice acquisition module 900. Therefore, preferably, the power supply module 400 is implemented as a general portable battery. However, the present invention is not limited thereto, and the power supply module 400 may be implemented to be supplied with an external AC power (for example, AC 220V) and to be converted into various DC powers.

The storage module 500 functions to store the game proceeding time and/or the timeout time for each sports game according to the input signal of the sixth operation switch unit 260 (for example, storage button) provided in the operation panel module 200 under the control of the control module 300.

Further, the storage module 500 may also function to store at least one program code executed through the control module 300 and at least one data set used by the program code.

For example, the storage module 500 may include at least one storage medium of flash memory, hard disk, multimedia card micro memory, card memory (for example, SD or XD memory), random access memory (RAM), static random access memory (SRAM), read-only memory (ROM), electrically erasable programmable read-only memory (EEPROM), programmable read-only memory (PROM), magnetic memory, magnetic disk, and optical disk.

The wireless communication module 600 functions to receive a scoreboard control signal transmitted from an external mobile communication terminal 1000 using a wireless communication method and transmit the received scoreboard control signal to the control module 300 under the control of the control module 300.

In this case, the wireless communication method may be, for example, a synchronous mobile communication network or an asynchronous mobile communication network. As an example of the asynchronous mobile communication network, a wideband code division multiple access (WCDMA) communication network is exemplified. In this case, although not shown in the drawings, the asynchronous mobile communication network may include a radio network controller (RNC). Meanwhile, although the WCDA communication network is exemplified as an example, examples thereof may include next-generation communication networks such as 3G LTE network, 4G network, and 5G network, and other IP networks based on IP.

The wireless communication method may be a communication network which is a high speed period network of a large communication network capable of a large capacity, long distance voice and data service, and may be a next-generation wireless network including Wi-Fi, WiGig, wireless broadband internet (Wibro), and world interoperability for microwave access (WiMax), which provide an internet or a high-speed multimedia service.

The Internet refers to a worldwide open computer network structure for providing TCP/IP protocol and several services existing in the upper-level hierarchy thereof, such as hyper text transfer protocol (HTTP), telnet, file transfer protocol (FTP), domain name system (DNS), simple mail transfer protocol (SMTP), simple network management protocol (SNMP), network file service (NFS), and network information service (NIS), and provides an environment in which the wireless communication module 600 of the scoreboard apparatus for various sports games according to an embodiment of the present invention can be connected to the external mobile communication terminal 1000. Meanwhile, the internet may be a wired or wireless internet, or may be a core network integrated with a wired public network, a wireless mobile communication network, or a portable internet.

The near field wireless communication module 700 functions to transmit/receive data to/from the external mobile communication terminal 1000 using a near field communication method under the control of the control module 300.

In this case, preferably, the near field communication method is any one of bluetooth communication, radio frequency identification (RFID) communication, infrared data association (IrDA) communication, ultra wideband (UWB) communication, and ZigBee communication.

The voice output module 800, which is a module for outputting external voice information data, is provided on one side of the main body 110 provided in the display module 100, and functions to output a voice signal so as to allow a user to audibly recognize external voice data received through a wired communication module, the wireless communication module 600, or the near field wireless communication module 700, or preset voice data.

The voice output module 800 is preferably implemented as a general speaker, but is not limited thereto. The voice output module 800 may be implemented as a connection jack or the like including a voice amplification circuit such that the user can listen through an earphone or headphone.

The voice acquisition module 900, which is a module for acquiring external peripheral voice information data, is provided on one side of the main body 110 provided in the display module 100 or connected to the main body 110 in a wired or wireless manner. Preferably, the voice acquisition module 900 is implemented as a general microphone. However, the present invention is not limited thereto, and a wireless microphone using a radio frequency may also be used.

The scoreboard apparatus for various sports games may further include a sound source information display unit which is formed on one side (preferably, upper side) of the main body 110 provided in the display module 100, and which visually displays operation functions (for example, volume, menu, operation state, and the like) for outputting voice or sound source data transmitted from an external module or an appliance/device (for example, USB memory, memory card, mobile phone, or the like) connected in a wired or wireless manner, or schematic information about the corresponding sound source or voice data under the control of the control module 300.

The scoreboard apparatus for various sports games may further include a USB interface unit 920 which is formed on one side (preferably, upper side) of the main body 110 provided in the display module 100, and which reads voice or sound source data transmitted from an external module or an appliance/device (for example, USB memory, mobile phone, or the like) connected through a USB port and transmits these voice or sound source data to the control module 300 under the control of the control module 300.

In this case, preferably, the control module 300 controls to receive and analyze the voice or sound source data transmitted through the USB interface unit 920 and output the analyzed voice or sound source data to the voice output module 800, and control to allow the sound source display unit 910 to display schematic information about the corresponding voice or sound source data.

The scoreboard apparatus for various sports games may further include a memory card reader unit 930 which is formed on one side (preferably, upper side) of the main body 110 provided in the display module 100, and which reads voice or sound source data transmitted from a memory card (for example, TF card, micro SD card, or the like) mounted through a memory card slit and transmits these voice or sound source data to the control module 300 under the control of the control module 300.

In this case, preferably, the control module 300 controls to receive and analyze the voice or sound source data transmitted through the memory card reader unit 930 and output the analyzed voice or sound source data to the voice output module 800, and control to allow the sound source display unit 910 to display schematic information about the corresponding voice or sound source data.

The scoreboard apparatus for various sports games may further include an audio interface unit 940 which is formed on one side (preferably, upper side) of the main body 110 provided in the display module 100, and which transmits audio data outputted from an external appliance/device (for example, mobile phone, navigator, or the like) connected through an auxiliary terminal to the control module 300 under the control of the control module 300.

In this case, preferably, the control module 300 controls to receive and analyze the audio data transmitted through the audio interface unit 940 and output the analyzed audio data to the voice output module 800, and control to allow the sound source display unit 910 to display schematic information about the corresponding audio data.

The scoreboard apparatus for various sports games may further include a sound source operation switch unit 950 which is formed on one side (preferably, upper side) of the main body 110 provided in the display module 100, and which outputs an input signal for operation of the voice output module 800 and/or the sound source information display unit 910 by the operation of a plurality of switches.

In this case, preferably, the control module 300 controls the operation of the voice output module 800 and/or the sound source information display unit 910 according to the input signal outputted from the sound source operation switch unit 950.

Meanwhile, when the sound source (for example, buzzer) generating signals generated through the eighth operation switch unit 280 and the sound source data (for example, MP3 file, and the like) externally inputted through the USB interface unit 920, the memory card reader unit 930 or the audio interface unit 940 are simultaneously outputted, noises occur. In this case, the control module 300 may control to receive the sound source data (for example, MP3 file, and the like) externally inputted through the USB interface unit 920, the memory card reader unit 930 or the audio interface unit 940 and output the received sound source data through the voice output module 800 according to the input signal inputted from a separately provided analog switch (not shown) at normal time, and may control to stop the sound source data (for example, MP3 file and the like) outputted through the voice output module 800 and output the sound source (for example, buzzer) generating signals generated through the eighth operation switch unit 280 to the voice output module 800 when the control module receives the sound source (for example, buzzer) generating signals generated through the eighth operation switch unit 280.

Figure 14:
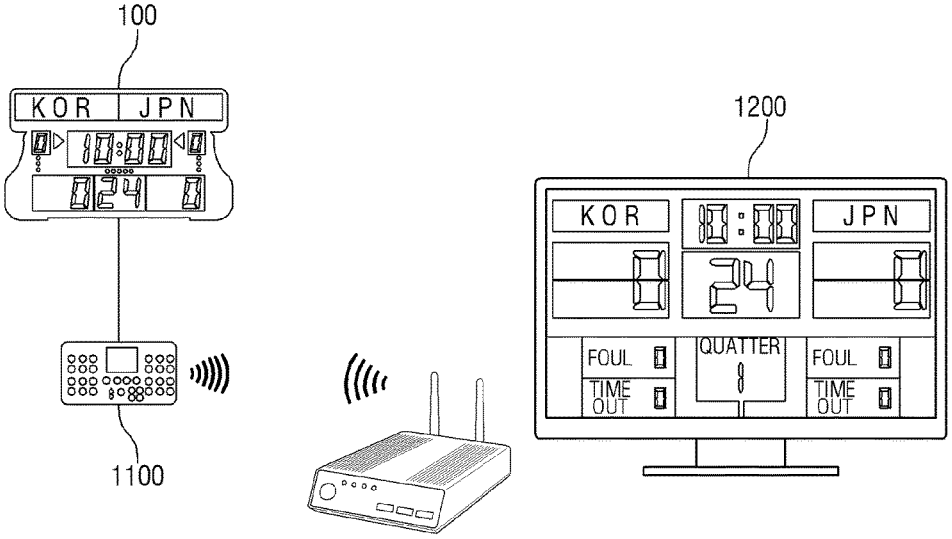
FIG. 14 is a usage state view of outputting an image to an external display device using the scoreboard apparatus for various sport games according to an embodiment of the present invention.

FIG. 14 is a usage state view of outputting an image to an external display device using the scoreboard apparatus for various sport games according to an embodiment of the present invention.

Referring to FIG. 14, game proceeding information is transmitted to an external display device 1200 (for example, monitor) through the image output module 1100 included in the scoreboard apparatus for various sports games, so that the same image as the image displayed on the display module according to an embodiment of the present invention may be displayed on an external display device 1200.

According to an embodiment of the present invention, the game proceeding information may be wirelessly transmitted to the external display device 1200 through the wireless communication module 600, and may be simultaneously transmitted to a plurality of monitors.

Figure 15:
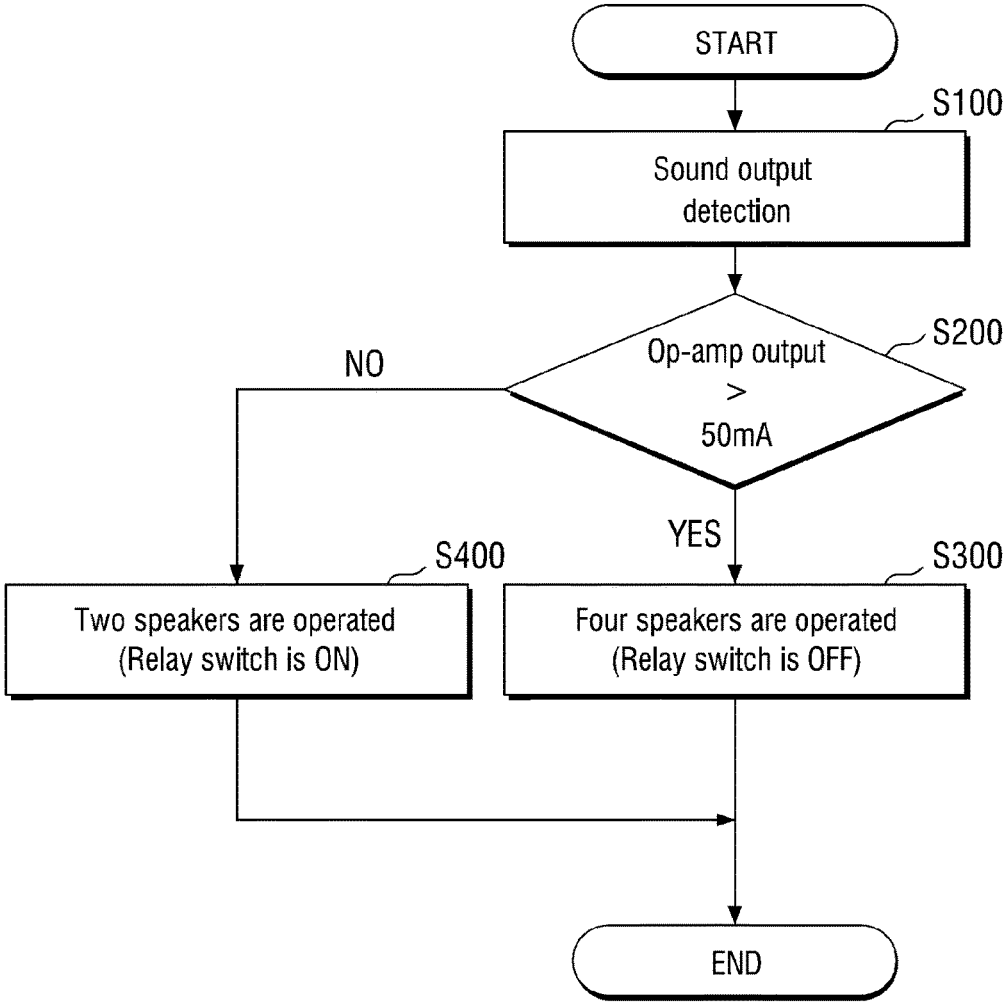
FIG. 15 is a flowchart illustrating an operation of the failure determination circuit unit according to an embodiment of the present invention.

FIG. 15 is a flowchart illustrating an operation of the failure determination circuit unit according to an embodiment of the present invention.

The scoreboard apparatus for various sport games according to an embodiment of the present invention further includes a failure determination circuit unit for determining whether the voice output module is normal or not.

The failure determination circuit unit according to an embodiment of the present invention operates by a failure determination algorithm, which algorithm is as shown in FIG. 15.

The failure determination circuit unit detects the sound source output from the voice output module (S100), and determines whether the output of the operational amplifier (Op-Amp) constituting the circuit unit is 50 mA or more (S200). If the output of the operational amplifier Op-Amp exceeds 50 mA, it is determined that the voice output module is normal, and the relay switch connection is maintained in the OFF state and the audio output of the four speakers is operated (S300).

On the other hand, if the failure determination circuit unit determines that the output of the operational amplifier Op-Amp is 50 mA or less, the relay switch connection is changed to the ON state, and only the audio output of the two speakers among the four speakers is operated (S400).

Meanwhile, the game proceeding information (for example, team name) displayed on the display module 100 and the external display device 1200 may be inputted or revised using a keyboard.

The various embodiments described herein may be implemented in a recording medium readable by a computer or a device similar thereto using, for example, software, hardware, or a combination thereof.

According to hardware implementation, the embodiments described herein may be implemented using at least one of an application specific integrated circuit (ASIC), a digital signal processor (DSP), a digital signal processing devices (DSPD), a programmable logic device (PLD), a field programmable gate array (FPGA), a processor, a controller, a micro-controller, a microprocessor, and an electrical unit for performing functions. In some cases, these embodiments may be implemented by the control module 300.

According to software implementation, embodiments such as procedures or functions may be implemented together with a separate software module that performs at least one function or operation. The software code may be implemented by a software application written in a suitable programming language. Further, the software code may be stored in the storage module 500 and executed by the control module 300.

As described above, the scoreboard apparatus for various sports games according to the present invention is easy to carry anywhere, can easily check the proceeding information about various sports games, and can be used universally in various sports games having different scoring systems and time-measuring sports games.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A scoreboard apparatus for various sports games, comprising:

a display module displaying proceeding information for each sports game;

an operation panel module including a plurality of operation switch units and outputting input signals for operating the display module through the operation of each of the operation switch units;

a control module receiving the input signals of each of the operation switch units provided in the operation panel module and displaying the proceeding information about a corresponding sports game on the display module according to a sports game selected by the input signals of each of the operation switch units; and a wireless communication module, under the control of the control module, receiving a scoreboard control signal transmitted from an external mobile communication terminal using a wireless communication method, wherein the control module displays the proceeding information about the corresponding sports game on the display module according to a preset sports game corresponding to an input signal of a selected operation switch unit when the control module continuously receives, for a preset reference time, the input signal from the selected operation switch unit selected from the plurality of operation switch units provided in the operation panel module.

2. The scoreboard apparatus of claim 1, wherein the operation panel module includes:

first operation switch units for counting plus points and minus points of scores of both teams, counting the number of fouls of both teams or set scores in game, and counting the number of timeouts of both teams, for each sports game;

a second operation switch unit for the start, stop and reset of game proceeding time or timeout time and the adjustment of game proceeding time or timeout time, for each sports game;

a third operation switch unit for the set, start, stop and reset of reference attack limit time and the adjustment of reference attack limit time, for each sports game;

a fourth operation switch unit for resetting game scores of both teams, for each sports game;

a fifth operation switch unit for changing the number of game quarters and the number of game sets, for each sports game;

a sixth operation switch unit for storing the game proceeding time or timeout time set, for each sports game; and a seventh operation switch unit for setting attack directions of both teams for each sports game.

3. The scoreboard apparatus of claim 1, wherein the wireless communication method of the wireless communication module is any one of bluetooth, radio frequency identification (RFID), infrared data association (IrDA), ultra wideband (UWB), ZigBee, and Wi-Fi.

4. The scoreboard apparatus of claim 1, further comprising:

a voice output module outputting voice information data; and a voice acquisition module acquiring external voice information data, wherein the control module controls the voice output module to output preset voice or sound source data or voice or sound source data received from an external mobile communication terminal and controls the voice output module to output the external voice information data acquired from the voice acquisition module, and the control module further includes a sound source information display unit visually displaying an operation function for outputting voice or sound source data to the voice output module and information about voice or sound source data.

5. The scoreboard apparatus of claim 4, wherein the operation panel module further includes an eighth operation switch unit for outputting a preset sound source to the voice output module.

6. The scoreboard apparatus of claim 4, further comprising:

an interface unit which is formed on one side of the display module, and which transmits voice or sound source data received from an external module or device through a USB port, a memory card or an AUX terminal to the control module, wherein the control module analyzes the voice or sound source data transmitted through the interface unit and outputs the analyzed voice or sound source data to the voice output module, and displays information about the voice or sound source data on the sound source information display unit.

7. The scoreboard apparatus of claim 4, further comprising:

a sound source operation switch unit outputting input signals, by operating a plurality of switches, for operating the voice output module and the sound source information display unit, wherein the control module controls the operation of the voice output module and the sound source information display unit according to the input signals outputted from the sound source operation switch unit.

8. The scoreboard apparatus of claim 4, further comprising:

a failure determination circuit unit for determining whether or not the voice output module is normal.

9. The scoreboard apparatus of claim 1, further comprising:

an image output module displaying, on an external display device, game proceeding information displayed on the display module, wherein the image output module transmits the game proceeding information to the external display device by way of wireless communication.

10. The scoreboard apparatus of claim 1, further comprising:

a power supply module for power supply, wherein the power supply module includes a battery.

* * * * *